United States Patent [19]

Sato et al.

[11] Patent Number: 4,995,320

[45] Date of Patent: Feb. 26, 1991

[54] CARRIAGE FOR INSPECTING A PIPING

[75] Inventors: Tomoaki Sato; Munetake Kondo, both of Tokyo, Japan

[73] Assignee: NKK Corporation, Tokyo, Japan

[21] Appl. No.: 389,045

[22] Filed: Aug. 3, 1989

[30] Foreign Application Priority Data

Nov. 28, 1988 [JP] Japan ..... 63-154386

[51] Int. Cl.[5] ..... B61B 13/04

[52] U.S. Cl. ..... 104/118; 104/93; 104/295; 105/30; 73/638

[58] Field of Search ..... 104/118, 138.1, 283, 104/288, 295; 105/30, 33, 101, 102, 104; 73/622, 637, 638

[56] References Cited

U.S. PATENT DOCUMENTS

| | | | |
|---|---|---|---|
| 1,189,501 | 7/1916 | Smith | 105/33 |
| 3,326,496 | 6/1967 | Auberson | 104/138.1 |
| 4,010,636 | 3/1977 | Clarke et al. | 73/638 |
| 4,175,224 | 11/1979 | Sims et al. | 104/118 |
| 4,785,902 | 11/1988 | Ochiai | 180/8.1 |
| 4,885,995 | 12/1989 | Antosh | 104/118 |

*Primary Examiner*—Robert P. Olszewski
*Assistant Examiner*—S. Joseph Morano
*Attorney, Agent, or Firm*—Frishauf, Holtz, Goodman & Woodward

[57] ABSTRACT

A carriage for inspecting a pipe, which has inspection instruments on board and which travels on the outer surface of the pipe, comprises a support member for carrying the inspection instruments, a pair of first wheeled travel bodies each of which include at least two magnetic wheels having substantially the same rotation plane, which rotation planes are substantially in parallel with the axial direction of the pipe. Further provided is a pair of second wheeled travel bodies each of which includes at least two magnetic wheels having substantially the same rotation plane, which rotation planes are substantially at right angles to the axial direction of the pipe. At least one of said pairs of wheeled travel bodies has an elevating means for adjusting a distance between the respective wheels thereof and a floor surface of the carriage.

12 Claims, 5 Drawing Sheets

CARRIAGE FOR INSPECTING A PIPING

BACKGROUND OF THE INVENTION

The present invention relates to a carriage which travels on the outer surface of a pipe for inspecting, cleaning and/or painting the pipe.

A carriage which travels on the surface of a pipe is often used for inspecting a pipe to determine the degree of deterioration of the pipe. Most of the prior art carriages used for inspecting a pipe are manufactured substantially in accordance with the diameter of the respective pipe to be inspected. Among the known carriages, there are a number of carriages which move in the axial direction of the pipe and inspect the pipe, and are arranged as if they held the pipe in their arms. These known carriages have a structure such that an inspection in the circumferential direction of the pipe is carried out not by a movement of the carriage in the circumferential direction of the pipe, but by a movement of sensors and the like mounted on the carriage, which sensors are caused to revolve around the pipe.

The prior art carriage travelling on the surface of the pipe has had the following difficulties:

(1) In the prior art carriage arranged as if holding a pipe in its arms, at least two operators are required for attaching or removing the carriage to or from the pipe. This is inefficient and takes much time.

(2) Since the carriage is designed in accordance with the respective diameters of the pipes, a given carriage cannot be used for pipes of any other diameters, or it can be used only for pipes within a limited range of diameters.

(3) In the case of aerial pipes, wherein several pipes are arranged in parallel to one another or in parallel with other structural members, a range of the pipes which are objects of inspection is small, since some of the pipes are located so that it is difficult to install conventional carriages. In this case, the use of the prior art carriage which is arranged as if holding the pipes in its arms is limited.

(4) Since a mechanism of the carriage for clearing differences in level on the outer surface of a pipe is not sufficiently adjustable, manpower is required for attaching and removing the carriage to or from the pipe when such differences in level or when large surface irregularities are encountered.

SUMMARY OF THE INVENTION

To overcome the above-mentioned difficulties in the prior art carriage for inspecting a pipe, it is an object of the present invention to provide a carriage for inspecting a pipe which can inspect pipes of many different diameters over a large range of diameters, and which can travel on the surfaces of the pipes, clearing differences in level or surface irregularities on the surfaces of the pipes.

To accomplish this object, the present invention provides a carriage for inspecting a pipe having inspection instruments on board and travelling on the surface of the pipe, comprising:

According to the present invention a carriage for inspecting an elongated pipe, which carriage is adapted to carry inspection instruments or the like on board and to travel on the outer surface of the pipe, comprises support means for carrying said inspection instruments or the like on board the carriage; a pair of first wheeled travel bodies coupled to said support means; and a pair of second wheeled travel bodies coupled to said support means. Each of said first travel bodies includes at least two first magnetic wheels which are magnetically attractive to said pipe; and first driving means for driving said at least two first magnetic wheels; said at least two first magnetic wheels having a common rotation plane which is parallel with the axial direction of said pipe. Each of said second travel bodies includes at least two second magnetic wheels which are magnetically attractive to said pipe; and second driving means for driving said at least two second magnetic wheels; said at least two second magnetic wheels having a common rotation plane which is substantially perpendicular to the axial direction of said pipe. Further provided is elevating means coupled at least to said at least two second magnetic wheels of said second wheeled travel bodies for adjusting a distance between said support means and said wheels to which said elevating means is coupled.

The above and other objects and advantages of the present invention will become apparent from the detailed description to follow, taken in connection with the appended drawings.

DETAILED DESCRIPTION

A carriage for inspecting a pipe according to a preferred embodiment of the present invention will be described with specific reference to FIGS. 1 to 11.

Figure 1:
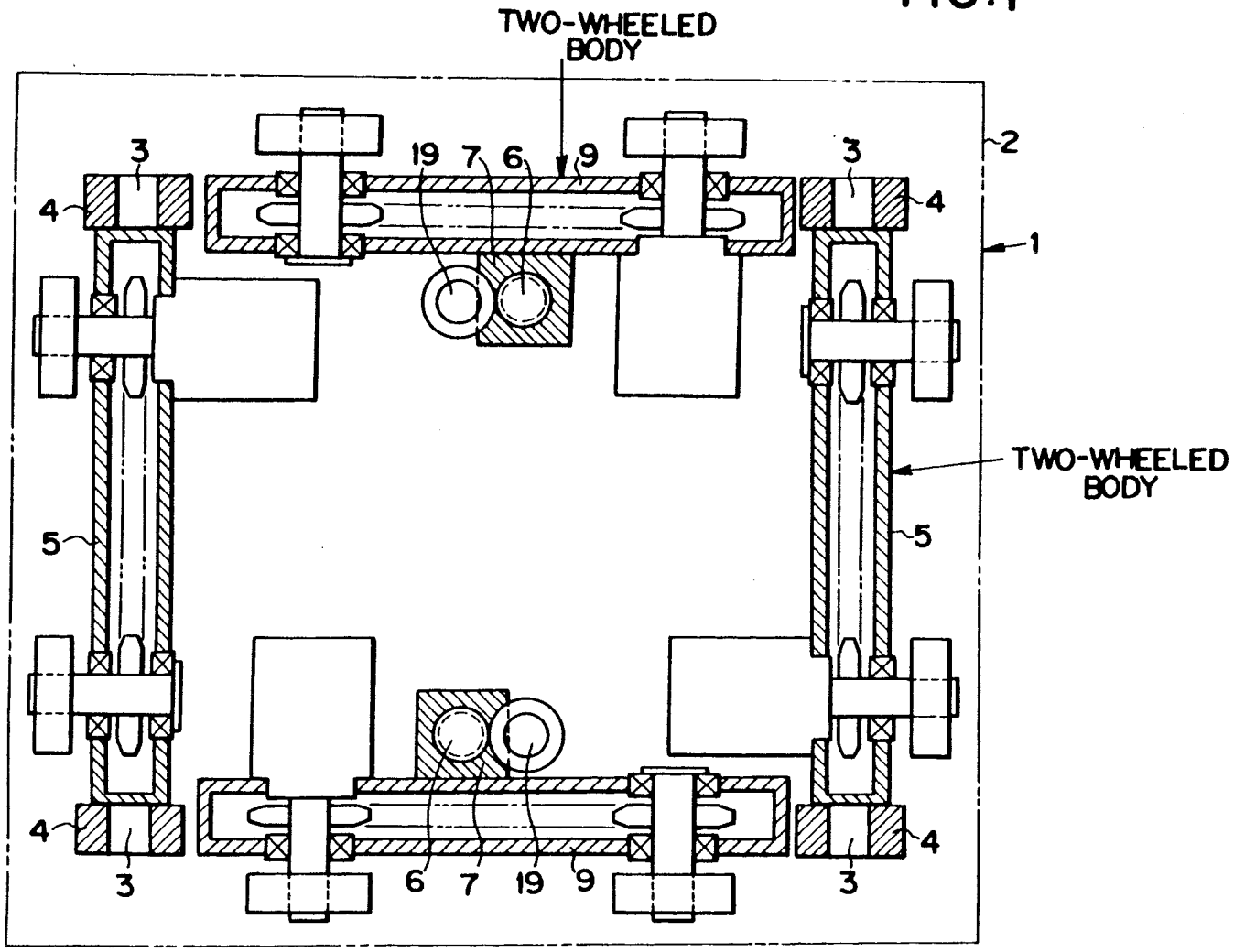
FIG. 1 is a top plan view of a travel carriage in accordance with the present invention.

FIG. 1 is a top plan view of the carriage for inspecting a pipe of the present invention, from which a support means such as a floor board of the carriage is removable and which is seen from the sides of two-wheeled travel bodies 5 and 9. A pair of first two-wheeled travel bodies 5 arranged in parallel with the axial direction of a pipe and a pair of second two-wheeled travel bodies 9 arranged perpendicular to the first two-wheeled travel bodies 5 are arranged under floor board 2 of carriage 1 for inspecting a pipe in accordance with the present invention. The first two-wheeled travel bodies 5 (see FIGS. 2 and 3) have journals 15 at their ends which are supported in through holes 3 of support member 4 arranged extending downward from under floor board 2. Accordingly, the first two-wheeled travel bodies 5 are arranged so that they can revolve around said journals 15. Second two-wheeled travel bodies 9 (see FIG. 10) have female screw members 7 threadedly engaged with rotary screws 6 arranged in a freely rotatable state extending vertically to the floor board 2. When motor 19 for rotating the screws rotates and the rotary screws 6 rotate, a distance between the floor board 2 and the two-wheeled travel bodies 9 becomes larger or smaller, depending upon the direction of rotation of rotary screws 6. Accordingly, when carriage 1 for inspecting a pipe is attached to the outer surface of a pipe, floor board 2 is moved nearer to or away from the outer surface of the pipe by means of rotation of rotary screws 6 which is caused by rotation of rotary motor 19.

Figure 2:
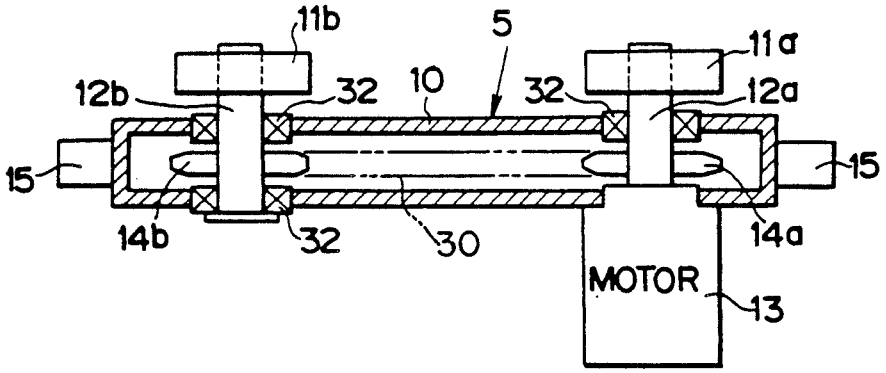
FIG. 2 is a top plan view of a first two-wheeled travel body.
Figure 3:
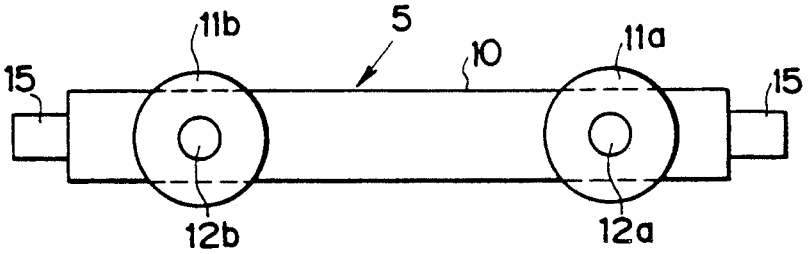
FIG. 3 is a side elevational view of the first two-wheeled travel body.
Figure 4:
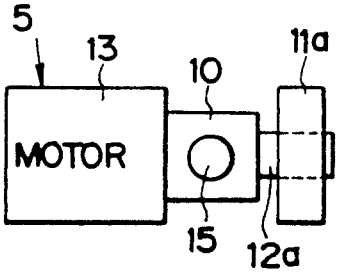
FIG. 4 is an elevational view of the first two-wheeled travel body.

FIGS. 2 to 4 are a top plan view, a side elevational view and an elevational view of one of the first two-wheeled travel bodies 5, the corresponding view of the other travel body 5 being identical. Each first two-wheeled travel body 5 comprises a support frame 10, a pair of magnetic travel wheels 11*a* and 11*b*, axle shafts 12*a* and 12*b* respectively coupled to travel wheels 11*a* and 11*b* and bearings 32 for the axle shafts 12*a*, 12*b*. Travel motor 13 is directly connected to one axle shaft, for example, shaft 12*a*. Sprocket wheels 14*a* and 14*b* are fixed to axle shafts 12*a* and 12*b*, respectively, and a chain 30 connects sprocket wheel 14*a* to sprocket wheel 14*b*, so that travel motor 13 effectively drives both axle shafts 12*a*, 12*b*.

Figure 5:
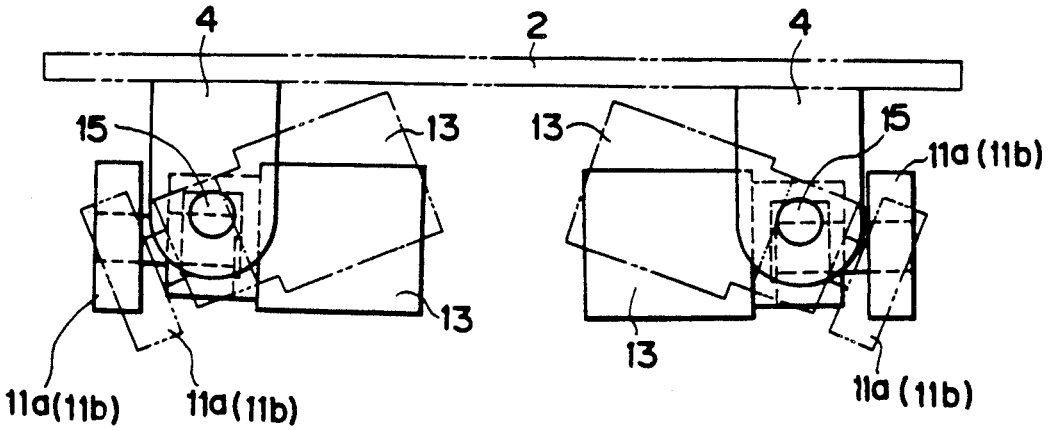
FIG. 5 is an explanatory view showing a state wherein a two-wheeled travel body revolves at right angles to the direction of its travel.
Figure 6:
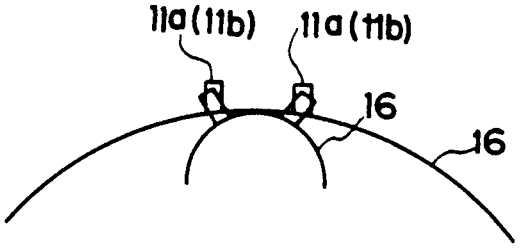
FIG. 6 is an explanatory view showing the relation between the diameter of a cylindrical body and the inclination of the wheels.

Journals 15 are mounted on both ends of support frame 10 in the longitudinal direction of frame 10. Journals 15 are inserted into through holes 3 of support members 4 extending downward from under floor board 2, the journals 15 being in a freely rotatable state as shown in FIG. 5. As shown in FIG. 6, the directions of axle shafts 12*a*, 12*b* of wheels 11*a* and 11*b*, respectively, are adjusted by making the first two-wheeled travel bodies 5 revolve so that the surfaces of the wheels 11*a*, 11*b* can always be at right angles to the outer surface of the pipe.

Since the travel carriage 1 is constituted in such a manner as described above, the travel carriage 1 can travel on the outer surfaces of cylindrical bodies 16 (see FIG. 6) of various diameters in the axial direction thereof by the use of a pair of first two-wheeled travel bodies 5 arranged in parallel with each other on opposite side portions of the carriage 1, as shown in FIG. 1. If two-wheeled travel bodies 5 are not made revolvable around the rotating journal axle 15, then various different sizes of travel carriages corresponding to the various different diameters of cylindrical bodies 16 must be made, since fixed wheels 11*a* and 11*b* cannot contact well the outer surfaces of a wide range of diameters of cylindrical bodies 16. For this reason, the journals 15 are provided in accordance with the present invention.

Figure 7:
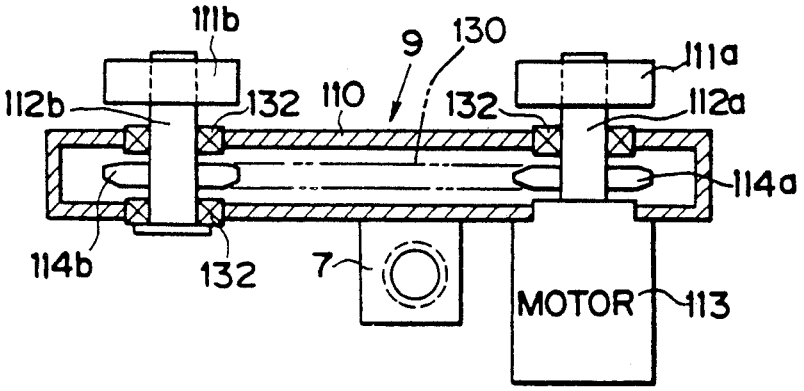
FIG. 7 is a top plan view of a second travel body.
Figure 8:
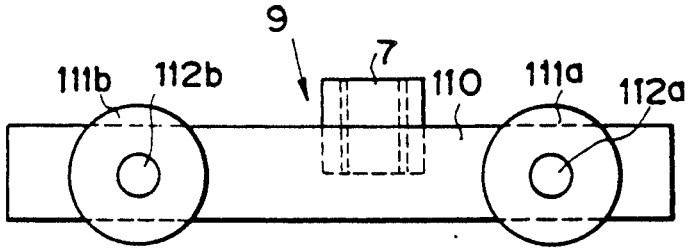
FIG. 8 is a side elevational view of the second travel body.
Figure 9:
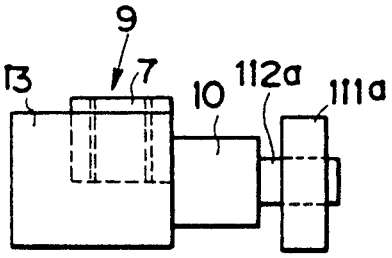
FIG. 9 is an elevation view of the second travel body.

FIGS. 7 to 9 are a top plan view, a side elevational view and an elevation view, respectively, showing one of the second two-wheeled travel bodies 9, the other one being identical. Since the two-wheeled travel bodies 9 have substantially the same construction as that of first two-wheeled travel bodies 5, the same reference symbols incremented by "100" are used for the portions corresponding to those of the first two-wheeled travel body 5.

Figure 10:
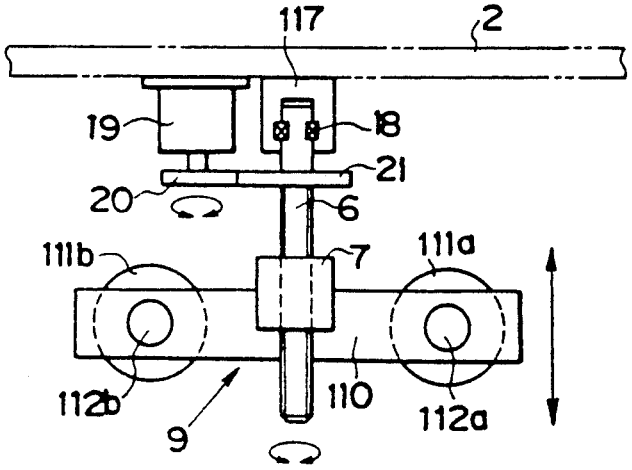
FIG. 10 is an explanatory view showing an elevating means of the second travel body of FIGS. 7–9.

Each second two-wheeled travel body 109 has a support frame 110, a pair of magnetic travel wheels 111*a* and 111*b*, axle shafts 112*a* and 112*b* supporting travel wheels 111*a* and 111*b*, respectively, and bearings 132 for the axle shafts 112*a*, 112*b*. Travel motor 113 is directly connected to one axle shaft 112*a*. A sprocket wheel 114*a* is fixed to axle shaft 112*a*, and another sprocket wheel 114*b* is fixed to axle shaft 112*b*. A chain 130 connects sprocket wheel 114*a* to sprocket wheel 114*b* so that motor 113 effectively drives both axle shafts 112*a*, 112*b*. The second two-wheeled travel body 9 is different from the first two-wheeled travel body 5 in that the second two-wheeled travel body 9 does not have any journals 15, but it does have a female screw member 7 which is fixed to the frame 110 of the second two-wheeled travel body 9 and which engages a rotary screw 6 held in a freely rotatable state by a support member 17 extending from under floor board 2 of the carriage by means of bearings 18 as shown in FIG. 10. The rotary screw 6 rotates with rotation of motor 19 fixed to the lower side of floor board 2 by means of a pinion gear 20 mounted on a rotary shaft of motor 19 and gear 21 fixed to rotary screw 6. The rotary screw 6 rotates, but does not move up-and-down. Therefore, the female screw members 7 together with the respective two-wheeled travel bodies 9 move nearer to or away from floor board 2 responsive to rotation of rotary screw 6, depending upon the direction of rotation of screw 6.

Accordingly, when the positions of the wheels of the second two-wheeled travel bodies 9 of the carriage for inspecting a pipe are nearer to floor board 2 than those of the wheels of the first two-wheeled travel bodies 5, a pair of first two-wheeled travel bodies 5 are made to travel in the axial direction of pipe 16, the wheels thereof contacting the outer surface of pipe 16. To the contrary, when the second two-wheeled travel bodies 9 are lowered by rotating rotary screws 6 by means of motors 19, so that the positions of the wheels of the second two-wheeled travel bodies 9 are a greater distance from floor board 2 than those of the wheels of first two-wheeled travel bodies 5, the wheels of the second two-wheeled travel bodies 9 contact the outer surface of the pipe 16 and the wheels of first two-wheeled travel bodies 5 separate from the outer surface of the pipe 16. When the carriage is in such a state, since the pair of second two-wheeled travel bodies 9 are arranged at right angles to the pair of first two-wheeled travel bodies 5, travel carriage 1 can travel in the circumferential direction of pipe 16 by means of the pair of second two-wheeled travel bodies 9. Since the wheels have magnetism (i.e., are magnetic), travel carriage 1 is magnetically held to pipe 16 and does not separate from the outer surface of the pipe 16. When the carriage 1 travels in the circumferential direction of the pipe 16, and it is desired to change the direction of travel to the axial direction of the pipe 16, it is only necessary to lift the second two-wheeled travel bodies 9 by making rotary screw 6 rotate in the proper direction.

Since the travel carriage 1 of the present invention is not of a type which holds a pipe in arms, but is of the surface travelling type, the travel carriage of the present invention can easily pass over differences in the level (i.e., irregularities or surface bumps or the like) on the outer surface of the pipe, or for example, a metallic material for mounting a pipe support on the outer surface of the pipe.

Figure 11:
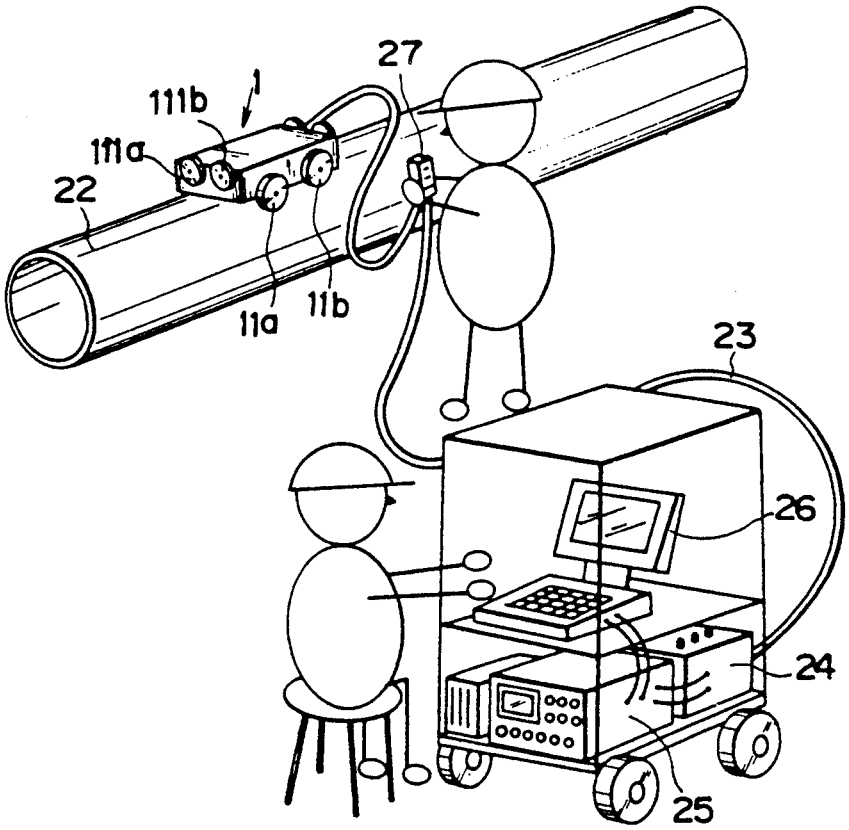
FIG. 11 is an explanatory view of an apparatus showing the travel carriage used to detect flaws of a pipe.

FIG. 11 is an explanatory view showing the use of a travel carriage 1 of the present invention applied to detection of flaws on pipe 16. In this case, travel carriage 1 is provided with a flaw detection sensor (not shown). Cables 23 are connected to travel carriage 1 for supplying electric power from battery 24 to travel carriage 1, and for sending data signals from the flaw detection sensor on carriage 1 to signal converter 25 and to data processing device 26, where the data is processed. Travel carriage 1 is caused to travel by an operator with the use of remote controller 27 connected to cables 23 which are used for transmission of power and signals. The wheels 11*a*, 11*b* and 111*a*, 111*b* are raised and lowered under control of the remote controller operated by the operator to permit the carriage to selectively travel axially or circumferentially of the pipe 16.

The means for driving, rotating and elevating the two-wheeled travel bodies 5 and 9 are not limited to the above-described and illustrated means. Various means already being used can be used. The motors may be electric or hydraulic, and various drive arrangements could be used.

The following effects can be obtained according to the present invention:

(1) The travel carriage can be easily attached to or removed from the outer surface of a cylindrical body.

(2) The same travel carriage can be applied to various diameters of cylindrical bodies. That is, the range of application of the travel carriage to various sizes of pipes is large.

(3) The travel carriage can be made to travel even in very narrow or confined working spaces, even when the pipe is surrounded by other constructions.

(4) The travel carriage can easily pass over any differences in level on the outer surface of the pipe, such as those surface differences formed by a pipe support, or the like.

(5) Since the wheels which contact the pipe are magnetic, the travel carriage 1 remains firmly on the outer surface of the pipe 16, without extra supports, even when it is upside down on the underside of pipe 16.

While the invention has been described with respect to specific embodiments, it should be clear that various alterations and modifications can be made within the scope of the accompanying claims.

What is claimed is:

1. In a carriage for inspecting an elongated pipe, which carriage is adapted to carry inspection instruments on board and travels on the outer surface of the pipe, the improvement comprising:

support means for carrying said inspection instruments on board the carriage;

a pair of first wheeled travel bodies coupled to said support means, each of said first travel bodies including:

at least two first magnetic wheels which are magnetically attracted to said pipe; and first driving means for driving said at least two first magnetic wheels;

said at least two first magnetic wheels having a common rotation plane which is parallel with the axial direction of said pipe;

a pair of second wheeled travel bodies coupled to said support means, each of said second travel bodies including:

at least two second magnetic wheels which are magnetically attracted to said pipe; and second driving means for driving at least two second magnetic wheels;

said at least two second magnetic wheels having a common rotation plane which is substantially perpendicular to the axial direction of said pipe;

elevating means coupled at least to said at least two second magnetic wheels of said second wheeled travel bodies for adjusting a distance between said support means and said wheels to which said elevating means is coupled said elevating means including:

at least one rotatable screw mounted for rotation vertically with respect to said support means;

female threaded members provided in the same number as said rotatable screws and threadably engaged with a respective rotatable screw, said female threaded members being mounted on a respective second wheeled travel body;

said female threaded members being coupled to said wheels for selectively raising and lowering said wheels relative to said at least one adjustable height wheeled body; and motor means for rotatably driving said rotatable screws for selectively raising and lowering said adjustable height wheeled body relative to a pipe on which said wheels are magnetically mounted; and means for inclining said at least two first magnetic wheels relative to said support means, thus inclining said common rotation plane of said at least two first magnetic wheels.

2. The carriage of claim 1, further comprising power source means arranged remote from said driving means for supplying power to said driving means via a transmission means.

3. The carriage of claim 2, wherein said transmission means comprises a cable.

4. The carriage of claim 1, wherein said first and second driving means each include:

axle shafts respectively coupled to respective wheels;

motor means coupled to said axle shafts for supplying motive power to said axle shafts; and control means coupled to said motor means for controlling directions of travel and a traveling speed of said carriage.

5. The carriage of claim 4, wherein said control means is manually operable.

6. The carriage of claim 4, wherein said control means is on the ground, remote from said carriage.

7. The carriage of claim 4, wherein said motor means is directly connected to said axle shafts for supplying motive power directly to said axle shafts.

8. The carriage of claim 7, wherein said control means is manually operable.

9. The carriage of claim 7, wherein said control means is on the ground, remote from said carriage.

10. The carriage of claim 1, wherein said adjusting means is provided for both of said first wheeled travel bodies.

11. The carriage of claim 1, wherein said adjusting means comprises means for pivoting both of said first wheeled travel bodies about an axis which is parallel with the axial direction of said pipe, for thereby inclining said at least two first magnetic wheels.

12. The carriage of claim 1, wherein each of said first and second wheeled travel bodies comprises two of said respective magnetic wheels.

* * * * *